United States Patent [19]

Cimochowski

[11] Patent Number: 4,481,746

[45] Date of Patent: Nov. 13, 1984

[54] MINI-MODULE AND METHOD OF INSTALLING SAME TO FILL GAPS BETWEEN ADJACENT INSULATION MODULES

[75] Inventor: Anthony E. Cimochowski, Sedalia, Colo.

[73] Assignee: Manville Service Corporation, Denver, Colo.

[21] Appl. No.: 355,823

[22] Filed: Mar. 8, 1982

[51] Int. Cl.[3] ..... E04B 1/78

[52] U.S. Cl. ..... 52/404; 52/506; 52/741

[58] Field of Search ..... 52/404, 406, 407, 509, 52/173 R, 306, 145, 506, 741; 156/71; 110/331

[56] References Cited

U.S. PATENT DOCUMENTS

| | | | |
|---|---|---|---|
| 3,952,470 | 4/1976 | Byrd | 52/509 |
| 4,001,996 | 1/1977 | Byrd | 52/509 |
| 4,055,926 | 11/1977 | Byrd | 52/509 X |
| 4,194,282 | 3/1980 | Byrd | 52/509 X |

*Primary Examiner*—J. Karl Bell

*Attorney, Agent, or Firm*—Ronald M. Halvorsen; Cornelius P. Quinn; Richard K. Thomson

[57] ABSTRACT

A mini-module for insertion into gaps between adjacent refractory fiber blanket modules lining a furnace. This mini-module is formed by folding the ends of a length of refractory fiber blanket toward each other, preferably forming a butt joint. This butt joint is positioned nearer the cold face of the module than the hot face thereby protecting the fiber ends exposed in the blanket ends from damage (e.g., shrinkage).

4 Claims, 2 Drawing Figures

FIG. 1.
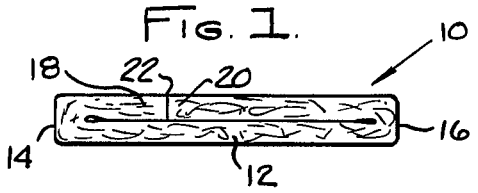
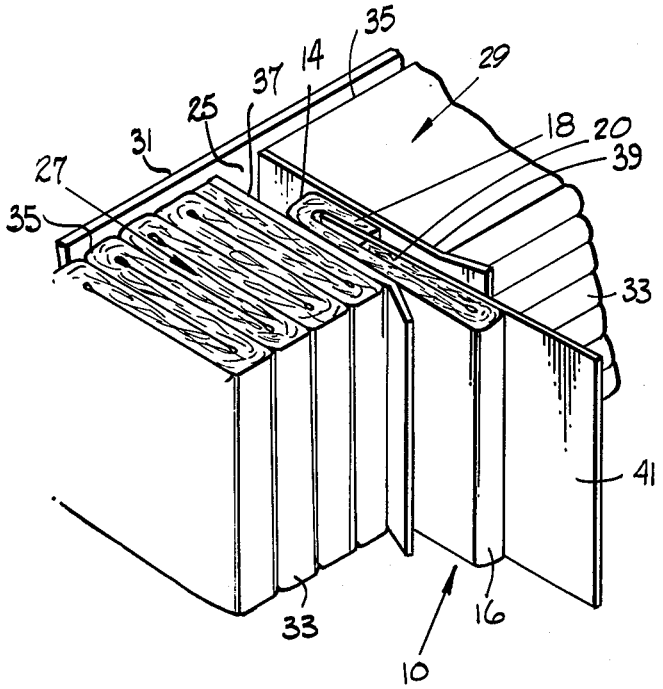
FIG. 2.

MINI-MODULE AND METHOD OF INSTALLING SAME TO FILL GAPS BETWEEN ADJACENT INSULATION MODULES

BACKGROUND AND SUMMARY OF THE INVENTION

Modules constructed from refractory fiber blankets are used in insulating the inner walls of high temperature furnaces. Exemplary of such modules are U.S. Pat. Nos. 3,952,470; 4,001,996; and 4,055,926. Repeated exposure to high temperatures can cause the fibers in some of the modules to shrink. This may result in some looseness between adjacent modules which would permit heat loss directly to and through the walls of the furnace.

One suggested remedial measure is described in U.S. Pat. No. 4,194,282. In that patent, a length of blanket which is equal to or exceeds the length of one complete modular fold, is wedged between such adjacent modules with the help of two spacer plates and a pusher blade. The heat loss through these gaps which were created by shrinkage is effectively halted. However, the ends of the filler blanket are positioned along the hot face of the furnace. The ends of the fibers in the blanket ends are thereby exposed to the highest temperatures and these fiber ends are most susceptible to heat induced shrinkage. In addition, these blanket ends make for a non-uniform, unsightly appearance.

The mini-module of the present invention solves these problems. A length of refractory fiber blanket is twice folded to position the ends toward each other preferably forming a butt joint. The mini-module is then wedged between two modules in the same manner as was done previously. The butt joint will be positioned on the side of the mini-module at some point located between the hot face and the cold face of the adjacent modules, protecting the fiber ends from the extreme temperatures inside the furnace. In order to effect the greatest amount of protection, it is preferred that the butt joint be located closer to the cold face than to the hot face so that the temperature to which the end fibers are exposed is no greater than necessary.

Other features, advantages and characteristics of the present invention will become apparent after a reading of the following specification.

BRIEF DESCRIPTION OF THE DRAWINGS

FIG. 1 is an end view of the mini-module of the present invention; and

FIG. 2 is a perspective view of the mini-module depicting the method of installation of the present invention.

DETAILED DESCRIPTION OF THE PREFERRED EMBODIMENTS

The mini-module of the present invention is shown generally at 10. A length of refractory fiber blanket 12 is folded once at 14 and again at 16 to bring the ends 18 and 20 adjacent one another. Preferably, ends 18 and 20 form a butt joint 22 which is off center for reasons to be discussed herebelow.

As depicted in FIG. 2, mini-module 10 is to be installed in a gap 25 between adjacent refractory fiber modules 27 and 29. These modules as depicted here, are of the serpentine type described in U.S. Pat. No. 4,001,996. Of course, this invention is equally applicable to the multi-piece modules shown in U.S. Pat. No. 3,952,470, or those shown in U.S. Pat. No. 4,055,926. In practice, modules 27 and 29 having a generally standard thickness (measured from the furnace wall 31) are installed on wall 31 in a parquet-like pattern. These modules are compressed and bound when manufactured. By installing them in a parquet-like pattern, when the bindings are removed, the modules will expand, some laterally and some vertically, into tight engagement with the adjacent modules making an integral wall of modules which line the furnace wall.

Occasionally, the modules will incompletely cover the wall (i.e., the length of the wall is not always an integral number of module lengths). Also, modules may not be installed tightly enough initially. While the expansion of the modules will fill some of the space, shrinkage of the fibers in the modules due to exposure to high temperatures can aggravate loose installation and create gaps. These gaps can allow heat to escape to and through the furnace wall defeating the insulation. In such situations, the mini-module of the present invention can be inserted.

Each of the refractory fiber modules has a hot face 33 positioned toward the interior of the furnace and a cold face 35 positioned adjacent furnace wall 31. The thickness of mini-module 10 (the distance between its hot and cold faces) is generally equal to the thickness of the standard module. To install the mini-module, spacer plates 37 and 39 are positioned between adjacent modules 27 and 29 on either side of gap 25 (the size of which has been exaggerated in FIG. 2). Pusher blade 41 is then inserted into fold 14 and under end 18. Mini-module 10 is wedged between spacer plate 37 and 39 into gap 25 by pushing on blade 41 until fold 16 is substantially flush with the inner or hot faces 33 of the modules. Spacer plates 37 and 39 and pusher blade 41 are then removed. The sides of mini-module 10 and the sides and ends respectively of modules 27 and 29 which have been compressed by this installation procedure, will expand and hold mini-module securely in place. Butt joint 22 is positioned along one side of the mini-module protecting the ends of the fibers in blanket ends 18 and 20 from the extreme temperatures of the furnace interior. Typically, the modules have a thickness of between 6 and 15 inches depending on the furnace operating temperature. By positioning the butt joint in the rear $\frac{1}{2}$ of the mini-module, the blanket ends will be protected by at least 3 to $7\frac{1}{2}$ inches of insulating blanket. In addition, any shrinkage which may result will not adversely effect the appearance of the modular interior. Rather, ends 18 and 20 may slightly draw away from each other opening butt joint 22.

Various changes, modifications and alternatives will become apparent following a reading of the foregoing specification. It is intended that all such changes, modifications and alternatives as come within the scope of the appended claims be considered part of the present invention.

I claim:

1. A mini-module for insertion into gaps between adjacent refractory fiber insulation modules lining a furnace each of said modules having a generally standard thickness defined by a hot face positioned toward the furnace interior and a cold face positioned adjacent the furnace wall, said mini-module comprising a length of refractory fiber blanket which is twice folded to form a flattened generally C-shaped member with two end edges being positioned adjacent one another at a point located between said hot face and said cold face.

2. The mini-module of claim 1, wherein said length of said refractory fiber blanket is substantially equal to twice the generally standard thickness of said modules the two end edges forming a butt joint.

3. The mini-module of claim 2, wherein the butt joint is positioned nearer the cold face than it is to the hot face.

4. A method of filling a gap between adjacent insulating modules of refractory fibers in a furnace, said modules each having a generally uniform thickness, comprising:

(a) inserting spacer plate means into the gap;

(b) forming a mini-module from a length of refractory fiber blanket by folding two ends of the blanket toward one another to form a butt joint and two lateral folds, said blanket length being substantially equal to twice said uniform thickness;

(c) inserting a pusher blade into one of said lateral folds;

(d) using said pusher blade to force said mini-module between said spacer plate means into said gap until the other of said lateral folds is substantially flush with an inner surface formed by the modules of generally uniform thickness; and (e) removing said pusher blade and said spacer plate means.

* * * * *